US008770783B2

(12) United States Patent
Opolka

(10) Patent No.: US 8,770,783 B2
(45) Date of Patent: Jul. 8, 2014

(54) TORCH WITH A ROTATIONALLY SYMMETRICAL OPTICAL ATTACHMENT

(75) Inventor: Rainer Opolka, Solingen (DE)

(73) Assignee: Zweibrueder Optoelectronics GmbH & Co. KG, Solingen (DE)

( * ) Notice: Subject to any disclaimer, the term of this patent is extended or adjusted under 35 U.S.C. 154(b) by 0 days.

(21) Appl. No.: 13/700,211

(22) PCT Filed: Jul. 12, 2011

(86) PCT No.: PCT/DE2011/001453

§ 371 (c)(1),
(2), (4) Date: Nov. 27, 2012

(87) PCT Pub. No.: WO2012/010153

PCT Pub. Date: Jan. 26, 2012

(65) Prior Publication Data

US 2013/0107509 A1 May 2, 2013

(30) Foreign Application Priority Data

Jul. 16, 2010 (DE) ..... 10 2010 027 326

(51) Int. Cl.
*F21L 4/02* (2006.01)

(52) U.S. Cl.
CPC ..... *F21L 4/027* (2013.01)
USPC ..... 362/187; 362/188

(58) Field of Classification Search
CPC ..... F21L 4/027; F21L 4/04
USPC ..... 362/308, 309, 187
See application file for complete search history.

(56) References Cited

U.S. PATENT DOCUMENTS

| | | | | |
|---|---|---|---|---|
| 2,254,962 | A | 9/1941 | Harris | |
| 2007/0263390 | A1 * | 11/2007 | Timinger et al. | 362/308 |
| 2009/0109687 | A1 * | 4/2009 | Householder et al. | 362/309 |

* cited by examiner

*Primary Examiner* — Mary Ellen Bowman
(74) *Attorney, Agent, or Firm* — Andrew Wilford

(57) ABSTRACT

The present invention relates to a flashlight having an auxiliary optical system that is rotation symmetrical to an optical axis, and that has an outer reflector part, an inner converging lens part, and a rear surface having a blind bore, and having a light-emitting diode (LED) arranged on a disk-shaped holder. In order to provide a flashlight having an auxiliary optical system, in which the emission characteristic can be set between a so-called moon setting and a focus setting, wherein the operability of the flashlight is to be as simple as possible and the desired setting can be found rapidly and reliably, according to the invention, the auxiliary optical system is displaceable relative to the LED delimited by two stops in such a manner that a substantially homogeneous light cone is generated in the case of contact of the auxiliary optical system on the holder.

8 Claims, 2 Drawing Sheets

TORCH WITH A ROTATIONALLY SYMMETRICAL OPTICAL ATTACHMENT

CROSS REFERENCE TO RELATED APPLICATIONS

This application is the US-national stage of PCT application PCT/DE2011/001453 filed 12 Jul. 2011 and claiming the priority of German patent application 102010027326.0 itself filed 16 Jul. 2010.

FIELD OF THE INVENTION

The present invention relates to a flashlight having an auxiliary optical system that is rotation symmetrical to an optical axis, and that has an outer reflector part, an inner converging lens part, and a rear surface having a blind bore, and having a light-emitting diode (LED) arranged on a holder disk.

BACKGROUND OF THE INVENTION

Flashlights of the type mentioned at the beginning having the described auxiliary optical systems are known in principle according to the prior art. For example, various auxiliary optical systems are described in U.S. Pat. No. 2,254,962, wherein a light source is displaceable within the rear blind bore to change the emission characteristic. The light source is longitudinally axially movable between two points that are both arranged inside the blind bore. The aperture angle of a light cone is essentially changed by a linear movement of the light source, so that objects can be illuminated at different spacings.

The known flashlights having the described auxiliary optical systems have the disadvantage that the light intensity within the light cone is not uniform, wherein the intensity is typically greatest on the optical axis, while it decreases continuously toward the edge of the light cone.

OBJECT OF THE INVENTION

It is therefore the object of the present invention to provide a flashlight having an auxiliary optical system, in which the above-described disadvantages are remedied.

In particular, a flashlight is to be provided, in which the emission characteristic can be set between a so-called moon setting and a focus setting. In the moon setting, a light cone having a large aperture angle and homogeneous light distribution therein is generated. In contrast, the focus setting is characterized by a light cone having a comparatively small aperture angle.

The operability of the flashlight is to be as simple as possible, whereby the desired setting can be found rapidly and reliably.

SUMMARY OF THE INVENTION

This object is achieved by the flashlight according to invention in which the auxiliary optical system is displaceable relative to the LED delimited by two stops in such a manner that a substantially homogeneous light cone is generated in the case of contact of the auxiliary optical system on the holder disk.

The emission characteristic of the flashlight according to the invention is essentially defined by two settings, namely a focus setting, in which the LED has the greatest possible spacing to the auxiliary optical system, and the moon setting, in which the auxiliary optical system is in contact with the holder disk, so that the LED comes to rest nearly at the height of the rear surface. In the focus setting, the emitted light is bounded to a relatively small light cone, so that objects at a greater spacing can be illuminated. In the moon setting, in contrast, a light cone having the largest possible angle is generated, wherein the light distribution in the flashlight according to the invention is uniform within the light cone and drops off sharply toward the edge. A particularly homogeneous illumination is thus provided. Through the design according to the invention, the preferred setting of the flashlight can be rapidly selected without cumbersomely searching for the correct spacing between the auxiliary optical system and the LED. According to a first embodiment, it is provided that the linear movement of the auxiliary optical system along the optical axis is delimited by a further stop that forms the greatest possible spacing between the LED and the auxiliary optical system, wherein the LED lies in the focal point of the auxiliary optical system in this setting. Depending on the design of the flashlight, this stop is formed by a stop surface in each case on the flashlight housing and the lamp head or within a connection element. The moon setting, in which the light is emitted homogeneously within a defined light cone, is then set optimally if the holder disk is in contact with the stop surface of the auxiliary optical system and accordingly the LED nearly coincides with the stop surface plane.

To dissipate the occurring heat, it is preferably provided that the holder disk has heat-conductive surfaces that are in contact with the housing. For example, a ring-shaped contact surface can be provided on the lower side of the holder disk for this purpose, with which it presses against a pedestal-shaped projection within the housing. In particular aluminum, copper, or brass is suitable as a preferred material for the heat conductive surfaces.

The particular emission characteristic of the flashlight according to the invention is substantially determined by the geometric design of the auxiliary optical system, wherein the length or size ratios are particularly significant in this regard. It is preferably provided in this regard that the ratio between the diameter of the reflector part and the diameter of the converging lens part is 0.55±0.1, preferably 0.55±0.05. In other words, the ratio between the diameter of the reflector part and the diameter of the converging lens part is 0.55, wherein deviations in the order of magnitude of 0.1, preferably 0.5 are tolerable, both in the positive direction and also in the negative direction. The ratio between the thickness of the converging lens part and the length of the reflector part is preferably 0.17±0.05, preferably 0.17±0.02.

In the focused setting, the ratio between the spacing of the LED to the contact surface and the spacing of the LED to a center point plane is 0.4±0.1, preferably 0.40±0.05.

Furthermore, it is preferably provided that the blind bore has a conical lateral surface that has an aperture angle of 23°±5°, preferably 23°±2°, relative to the longitudinal axis.

According to a particularly preferred embodiment, various actual dimensions of the geometric parts are provided, wherein preferably the diameter of the reflector part is 20.8±1 mm, the diameter of the converging lens part is 11.4±1 mm, the length of the auxiliary optical system is 11.6±1 mm, the thickness of the converging lens part is 3.04±0.5 mm or in the focused setting the spacing between LED and contact surface is 3.58±0.5 mm and the spacing between LED and a center point plane is 8.88±1 mm.

The converging lens part is preferably delimited by two surfaces having convex curves of different strengths, wherein the radius of the light entry surface is greater than the radius of the light exit surface.

BRIEF DESCRIPTION OF THE DRAWING

Further preferred designs and embodiments of the present invention are explained hereafter on the basis of the figures. In the figures.

SPECIFIC DESCRIPTION OF THE INVENTION

Figure 1A:
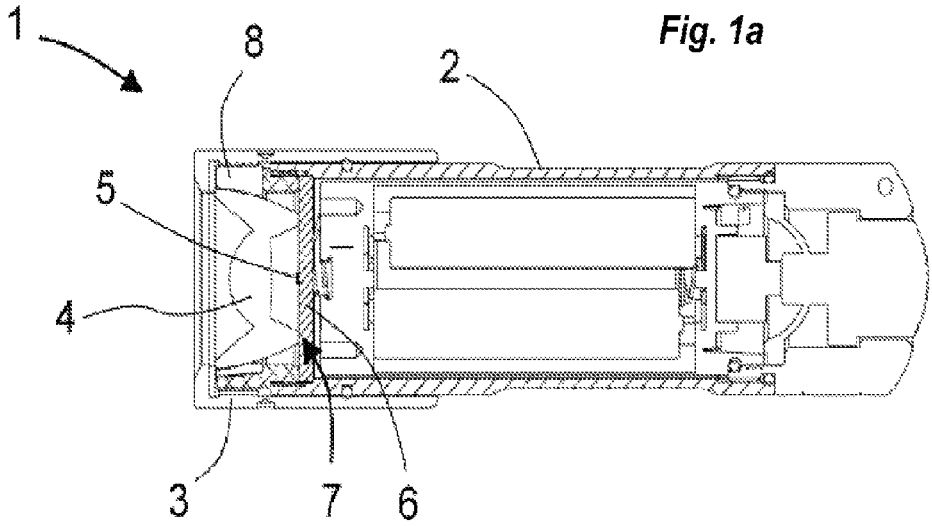
FIGS. 1*a* and 1*b* each show an embodiment of a flashlight according to the invention in two different settings.

According to the invention, a flashlight 1 according to the invention has a housing 2, a lamp head 3, an auxiliary optical system 4, and an LED 5. The auxiliary optical system 4 is mounted in the lamp head 3 so as to e longitudinally axially displaceable relative to the housing 2. On the housing side, the LED 5 is fastened on a holder disk 6, so that the auxiliary optical system 4 is displaceable as a whole relative to the LED 5. Displacement of the lamp head 3 or the auxiliary optical system 4 is delimited by two stops. On the one hand, the holder disk 6 forms a stop for the auxiliary optical system 4, for which purpose the auxiliary optical system 4 has a rear surface designed as a stop surface 7. On the other hand, in the illustrated embodiment, displacement is possible via a connection element 8 that connects the lamp head 3 and the housing 2 to one another and that has a stop (not shown).

Figure 1B:
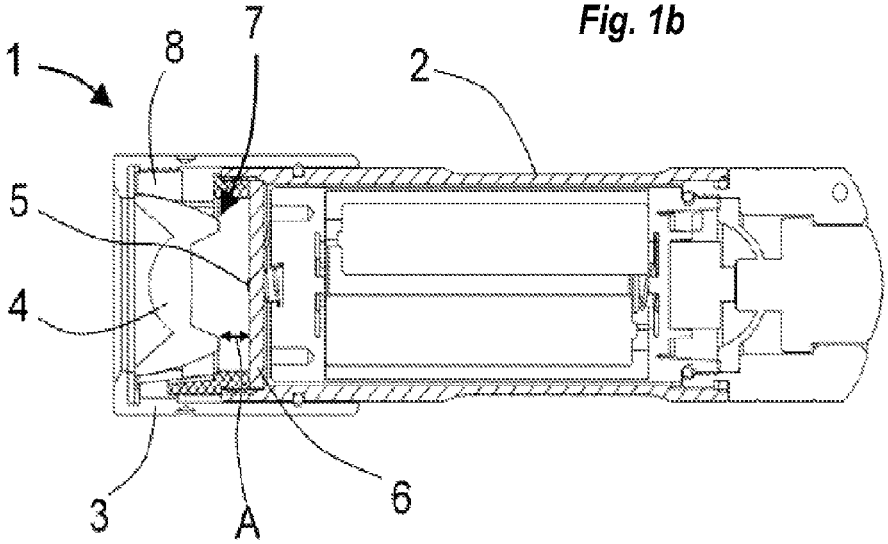

FIG. 1*a* shows a setting in which the auxiliary optical system 4 is in contact with the holder disk 6, so that the LED 5 nearly touches the stop surface plane. In this setting, the emitted light beam has a large emission angle within which light distribution is homogeneous. FIG. 1*b*, in contrast, shows a focused setting, where the auxiliary optical system 4 and the holder disk 6 are arranged at the spacing A from one another.

Figure 2:
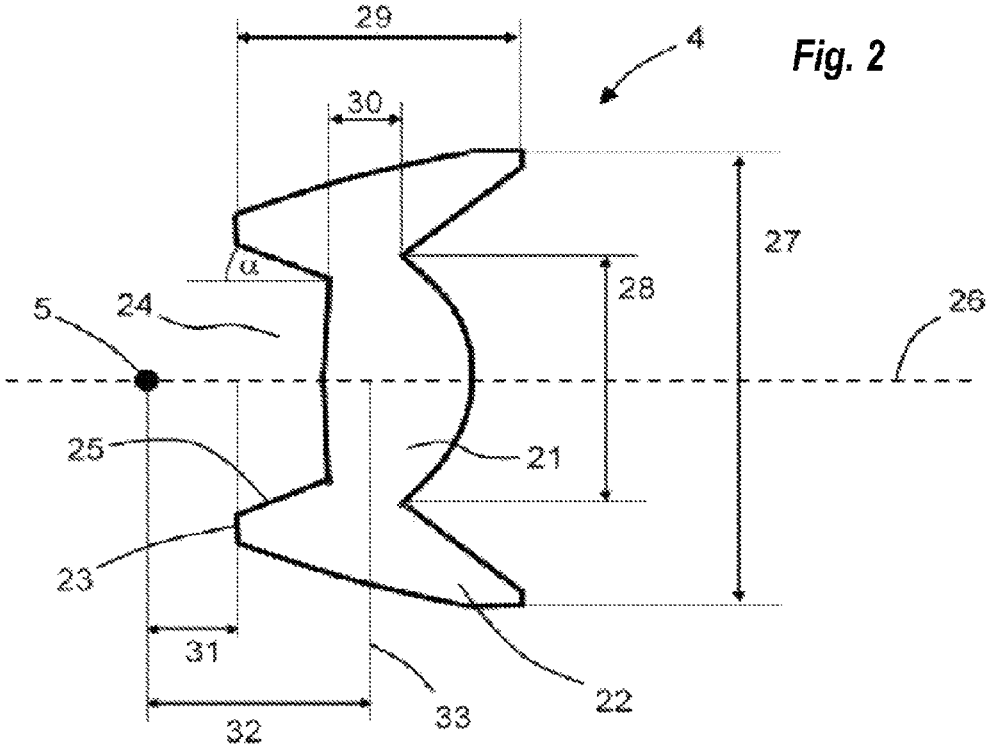
FIG. 2 shows an auxiliary optical system.

Actual dimensions or size ratios of an auxiliary optical system 4 are shown in FIG. 2. The auxiliary optical system 4 has an inner converging lens part 21, an outer reflector part 22, and a rear surface 23 that has a pocket hole 24. The pocket hole 24 is delimited by a frustoconical lateral surface 25 that has an aperture angle $\alpha$ of 23° relative to the longitudinal axis 26. The diameter 27 of the reflector part 22 is 20.8 mm, while the converging lens part 21 has a diameter 28 of 11.4 mm. The illustrated auxiliary optical system 4 is a total of 11.6 mm long (length 29) and the converging lens part has a thickness 30 of 3.04 mm. In the focused setting, i.e., at a maximum spacing between the auxiliary optical system 4 and the holder disk 6, the spacing 31 between LED 5 and stop surface 23 is 3.58 mm and the spacing 32 between LED 5 and a center point plane 33 is 8.88 mm. A value of 0.4 thus results for the ratio (31/32) between the spacing 31 of the LED 5 to the contact surface 23 and the spacing 32 of the LED to the center point plane 33, a value of 0.55 results for the ratio (28/27) between the diameter 28 of the converging lens part 21 and the diameter 27 of the reflector part 22, and a value of 0.26 results for the ratio (30/29) of the thickness 30 of the converging lens part 21 to the length 29 of the auxiliary optical system 4.

Figure 3:
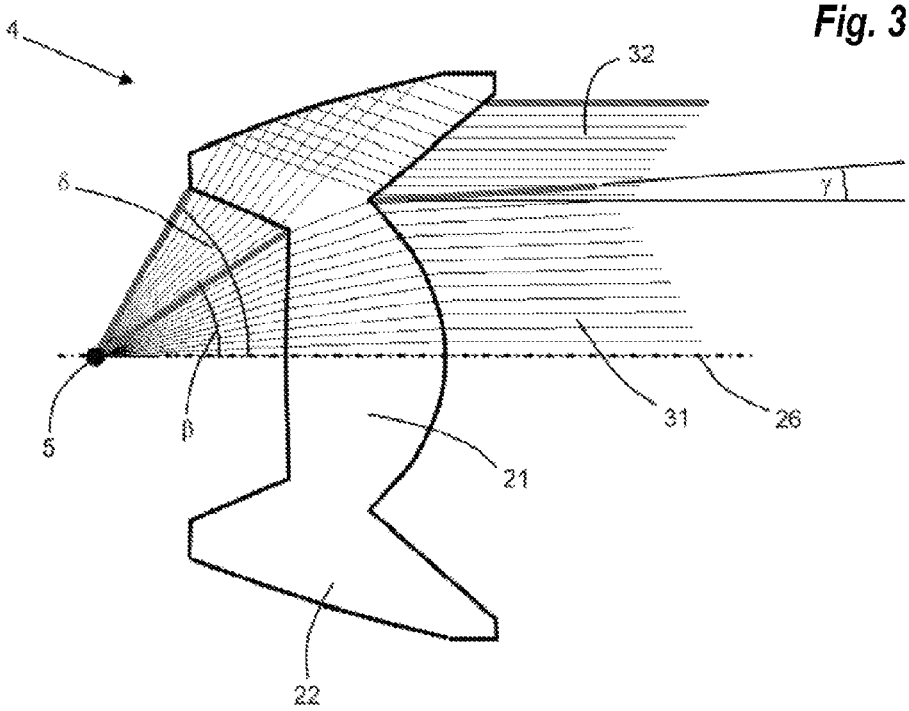
FIG. 3 is a schematic view of the emission characteristic of the auxiliary optical system.

FIG. 3 schematically shows the beam in a focused setting in which the light beam emitted by the LED 5 at an angle $\beta$ of ±32° falls on the converging lens part 21. This light is bundled by the converging lens part 21 to form a light cone 31 having a cone angle $\gamma$ of 4°. The remaining light emitted at an angle $\delta$ of 32° to 60° by the LED 5 falls on the reflector part 22 that generates a beam bundle 32 parallel to the axis.

The invention claimed is:

1. In a flashlight having an auxiliary optical system that is rotation symmetrical to an optical axis, and that has an outer reflector part, an inner converging lens part, and a rear surface having a blind bore, a holder disk forming a rear stop, and a light-emitting diode mounted on the holder disk, the improvement wherein the auxiliary optical system is displaceable relative to the LED through a stroke between moon and focused end settings delimited by a front stop in the housing and the rear stop of the holder disk in such a manner that a substantially homogeneous light cone is generated in the focused end setting on contact of the auxiliary optical system with the rear stop of the holder disk;

the ratio between the diameter of the reflector part and the diameter of the converging lens part is 0.55±0.1; and the ratio between the thickness of the converging lens part and the axial length of the reflector part is 0.17±0.05.

2. The flashlight as claimed in claim 1, wherein linear movement of the auxiliary optical system along the optical axis is delimited by a further stop that forms the greatest possible distance between the LED and the auxiliary optical system, and the LED lies in the focal point of the auxiliary optical system in this setting.

3. The flashlight as claimed in claim 1, wherein the holder disk has heat-conductive surfaces that are in contact with a housing.

4. The flashlight as claimed in claim 1, wherein, in the focused setting, the ratio between the distance of the LED to the contact surface and the distance of the LED to a center point plane is 0.4±0.1.

5. The flashlight as claimed in claim 1, wherein the blind bore has a conical lateral surface that has an aperture angle of 23°±5° relative to the longitudinal axis.

6. In a flashlight having an auxiliary optical system that is rotation symmetrical to an optical axis, and that has an outer reflector part, an inner converging lens part, and a rear surface having a blind bore, a holder disk forming a rear stop, and a light-emitting diode mounted on the holder disk, the improvement wherein the auxiliary optical system is displaceable relative to the LED through a stroke between moon and focused end settings delimited by a front stop in the housing and the rear stop of the holder disk in such a manner that a substantially homogeneous light cone is generated in the focused end setting on contact of the auxiliary optical system with the rear stop of the holder disk;

the diameter of the reflector part is 20.8 mm±1 mm, the diameter of the converging lens part is 11.4 mm±1 mm, the axial length of the auxiliary optical system is 11.6 mm±1 mm, the thickness of the converging lens part is 3.04 mm±0.5 mm, and in the focused setting, the distance between LED and contact surface is 3.58 mm±0.5 mm and the distance between LED and a center point plane is 8.88 mm±1 mm.

7. The flashlight as claimed in claim 1, wherein the converging lens part is delimited by two surfaces having convex curves of different strengths and having radii of curvature of the light entry surface that is greater than the radius of the light exit surface.

8. A flashlight comprising:

a housing;

a holder disk fixed in the housing and forming a rear stop;

a light-emitting diode mounted on the holder disk, directed forward along an axis, and having an outer reflector and an inner converging lens;

a rotation-symmetrical auxiliary optical system axially displaceable in the housing forward of the holder disk and having an outer reflector part, an inner converging lens part, and a rear surface having a blind bore, a ratio between a diameter of the reflector part and a diameter of the converging lens part being 0.55±0.1 and a ratio between a thickness of the converging lens part and a length of the reflector part being 0.17±0.05; and a front stop on the housing limiting with the rear stop on the holder disk axial movement of the optical system between respective front and rear settings such that a substantially homogeneous light cone is generated in the rear setting on contact of the auxiliary optical system with the rear stop of the holder disk.

* * * * *